United States Patent [19]

Mayo

[11] Patent Number: 5,016,760

[45] Date of Patent: May 21, 1991

[54] COLLAPSIBLE ORGANIZATIONAL RACK

[75] Inventor: Stephen I. Mayo, New York, N.Y.

[73] Assignee: Artistic Desk Pad & Novelty Co., Inc., New York, N.Y.

[21] Appl. No.: 408,545

[22] Filed: Sep. 18, 1989

[51] Int. Cl.[5] ..... A47F 5/00

[52] U.S. Cl. ..... 211/55; 211/88

[58] Field of Search ..... 211/55, 10, 58, 104; 229/69, 71

[56] References Cited

U.S. PATENT DOCUMENTS

| | | | |
|---|---|---|---|
| D. 276,777 | 12/1984 | Evenson | 211/55 X |
| 987,210 | 3/1911 | Wynne | 211/55 X |
| 1,551,302 | 8/1925 | Gabel | 211/55 X |
| 3,717,188 | 2/1973 | Green | 211/55 X |
| 3,983,649 | 10/1976 | Ellis et al. | 211/55 X |
| 4,062,452 | 12/1977 | Bartholomew | 211/55 |
| 4,475,659 | 10/1984 | Wells et al. | 211/55 |

FOREIGN PATENT DOCUMENTS

| | | | |
|---|---|---|---|
| 1156414 | 6/1969 | United Kingdom | 211/55 |

*Primary Examiner*—Robert W. Gibson, Jr.

*Attorney, Agent, or Firm*—Sprung Horn Kramer & Woods

[57] ABSTRACT

An organizational rack comprising a rigid backboard, a plurality of substantially rigid face elements hingedly connected adjacent their bottoms to said backboard, and a pair of flexible side flaps for each of said face elements, each flap being essentially triangular in configuration with an apex pointing downward and connecting one side of a face element with the backboard, whereby the top of each face element can be pivoted about its bottom as a fulcrum from flat position adjacent said backboard to a position spaced from said backboard so as to form a pocket with said backboard.

7 Claims, 3 Drawing Sheets

COLLAPSIBLE ORGANIZATIONAL RACK

The present invention relates to an organizational rack which is easy to make, ship and use.

Organizational racks comprising a plurality of vertically spaced pockets with a common backboard, for hanging on a wall, are known and perform satisfactorily. However, they present the possibility of damage and also take considerable space during storage and shipment.

The present invention relates to an improved rack of that general type which avoids these problems.

These and other advantages are realized in accordance with the present invention pursuant to which there is provided an organizational rack comprising a rigid backboard, a plurality of substantially rigid face elements hingedly connected adjacent their bottoms to said backboard, and a pair of flexible side flaps for each of said face elements, each flap being essentially triangular in configuration with an apex pointing downward and connecting one side of a face element with the backboard, whereby the top of each face element can be pivoted downward about its bottom as a fulcrum from flat position adjacent said backboard to a position spaced from said backboard so as to form a pocket with said backboard.

Advantageously the bottom of one face element is below the top of the face element just below it, the lateral location where the lower face element is connected with said backboard being beyond the corresponding side of the upper face element, thereby forming a pocket into which the upper face element extends downwardly. Each pocket extends into its next lower pocket a distance of advantageously about 25 to 50%, and preferably about 35 to 40%, of the height of the lower pocket.

This serves to protect the bottom of each upper pocket without excessively interfering with the containing capacity of each lower pocket.

Advantageously there are at least three face elements, each essentially rectangular in configuration and provided with a detent in its top edge.

In accordance with a preferred embodiment the backboard and face elements are either relatively rigid plastic or are covered with plastic and are thermally joined to each other and to the flaps.

The invention will be further described with reference to the accompanying drawings wherein.

Figure 1:
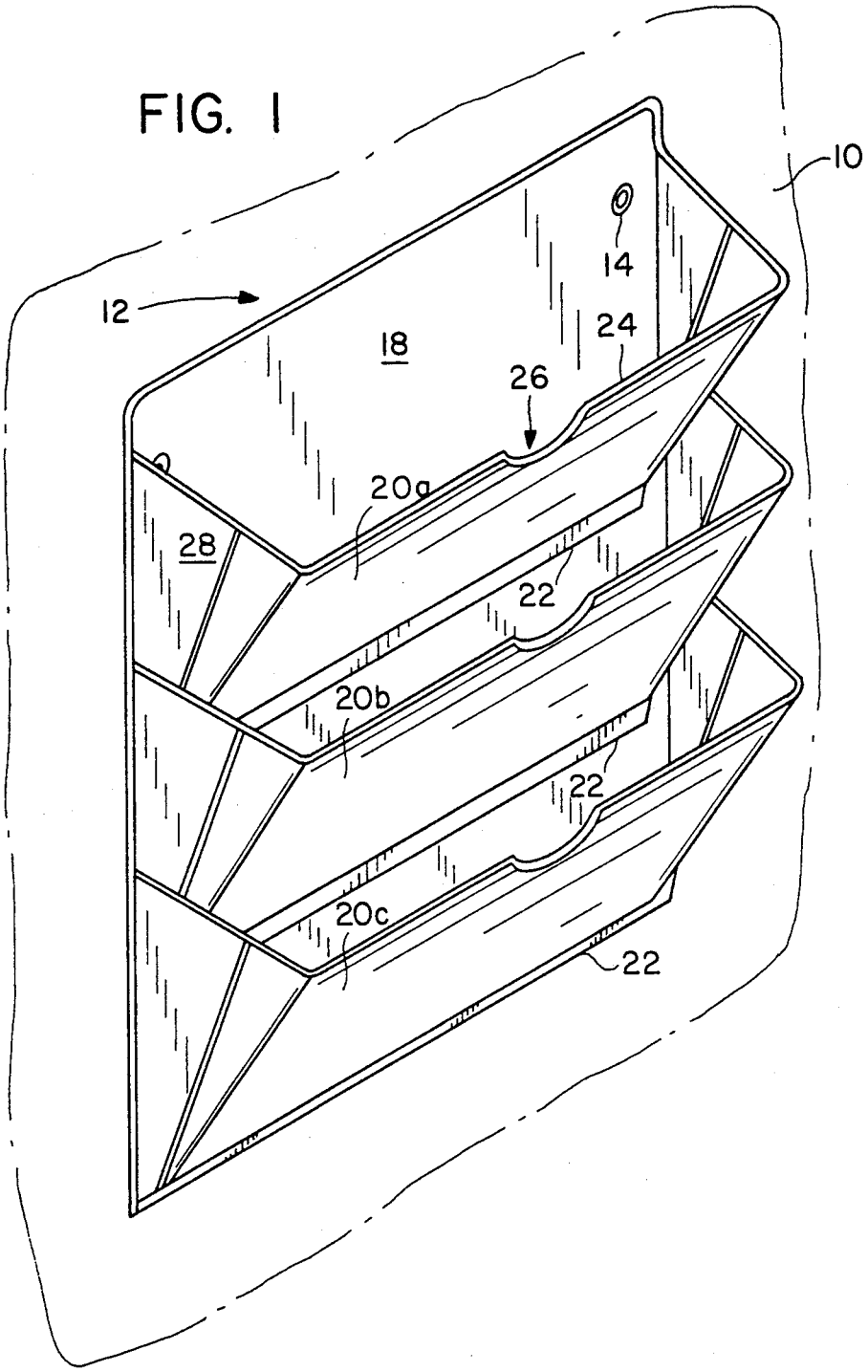
FIG. 1 is a perspective view of the rack mounted on a wall and in fully opened position.
Figure 2:
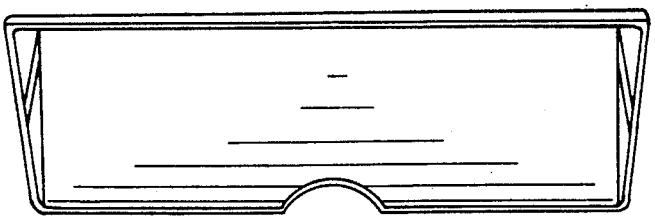
FIG. 2 is a top view of the rack of FIG. 1.
Figure 5:
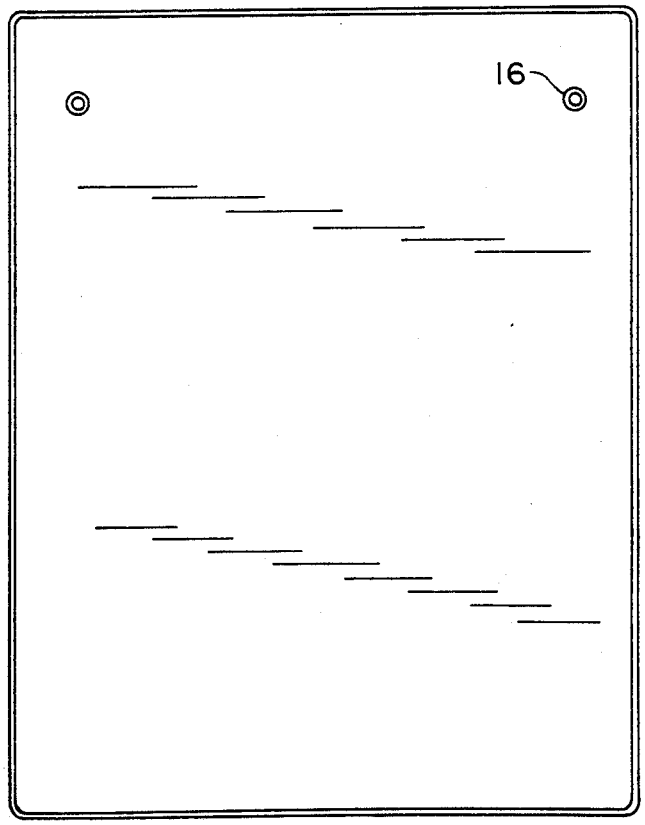
FIG. 5 is a rear view.
Figure 6:
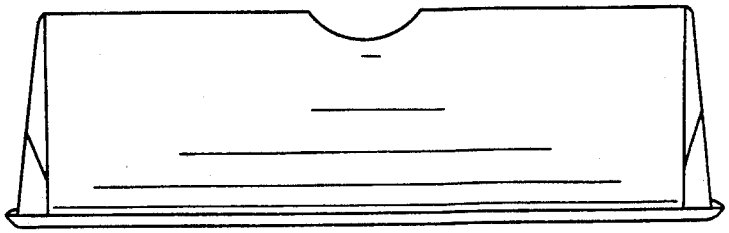
FIG. 6 is a bottom view.

Referring now more particularly to the drawings, in FIG. 1 there is shown a vertical surface 10 such as a wall, room divider or desk, on which there is hung an organizer 12 in accordance with the invention by means of nails 14 projecting through openings 16 (FIGS. 5).

The organizer 12 comprises a substantially rigid backboard 18 to which substantially rigid face elements 20*a*, 20*b* and 20*c* are hingedly connected, each adjacent its lower edge 22. The upper edge 24 of each face element is provided with a detent 26 for easier access to its pocket, described hereinbelow.

Figure 7:
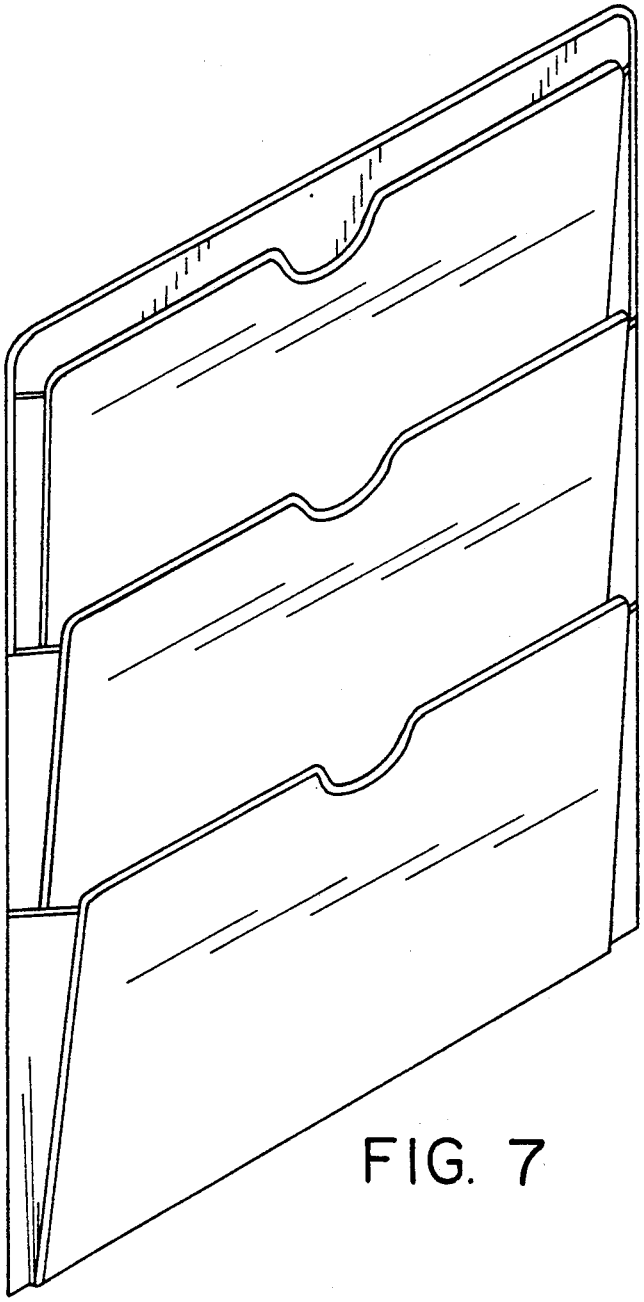
FIG. 7 is a perspective view of the rack in collapsed position.

Each face element 20 is connected at its lateral edges to the backboard 18 by an essentially triangular flap 28 so that in extended condition as in FIG. 1 each forms an essentially triangular pocket for holding papers or similar articles. Each pocket can be fully open as in FIG. 1 or fully closed as in FIG. 7 (especially suited for shipping and storage) or anywhere in between. The content of articles in a pocket may determine how open it is.

Figure 3:
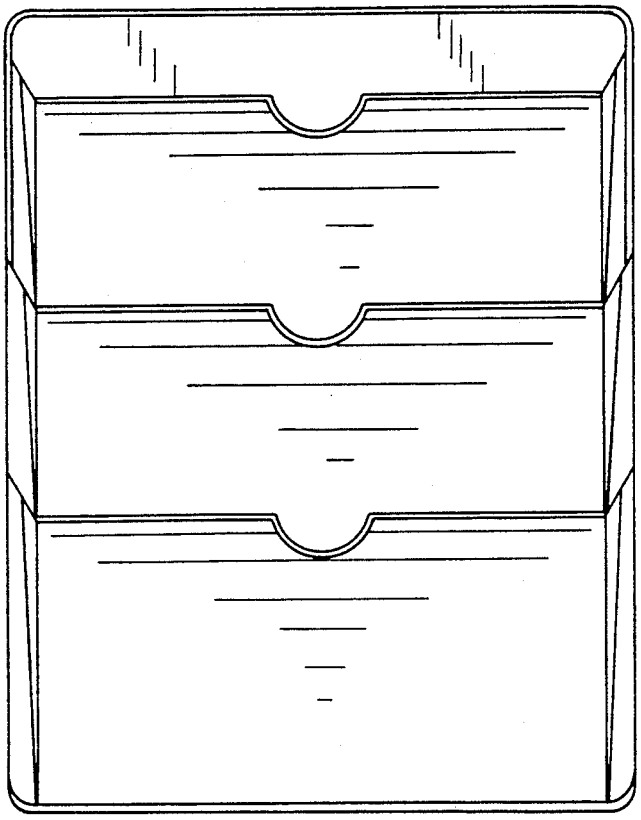
FIG. 3 is a front view.
Figure 4:
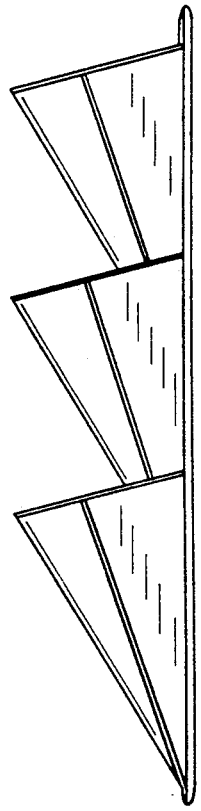
FIG. 4 is a side view.

As can be best seen in FIG. 3, the face elements 20 are narrower than the backboard 18, i.e. the front of each pocket is somewhat narrower than its rear. Accordingly the bottom of one pocket, i.e. face element, can fit into the pocket therebelow. Advantageously the extent of downward projection is about 25 to 50%, as noted hereinabove. This protects the bottom edges of the upper pockets.

As seen in FIG. 5, eyelets 16 are provided in the backboard 18 through which nails 14 or hooks can project, as in FIG. 1, for mounting.

The backboard and face elements can be formed of wood, pressed wood, metal or plastic. The flaps can be of fabric but are preferably of plastic with a fold line 30 to facilitate neat collapsing.

Preferably the faces of the backboard and face elements are thermoplastic, as are the flaps, these elements being joined to one another by virtue of such thermoplasticity, as by heat sealing. Rather than being solid and unitary, each backboard and face element may be made of two sheets of plastic peripherally joined around a solid core.

It will be understood that the specification and examples are illustrative but not limitative of the present invention and that other embodiments within the spirit and scope of the invention will suggest themselves to those skilled in the art.

What is claimed is:

1. An organizational rack comprising a rigid backboard, a plurality of substantially rigid face elements hingedly connected adjacent their bottoms to said backboard, and a pair of flexible side flaps for each of said face elements, each flap being essentially triangular in configuration with an apex pointing downward and connecting one full side of a face element with the backboard, whereby the top of each face element can be pivoted about its bottom as a fulcrum from flat position adjacent said backboard to a position spaced from said backboard so as to form a pocket with said backboard, the bottom of one face element extending into the pocket just below at a distance corresponding to about 25 to 50% of the height of the pocket, the lateral location where the lower face element is connected with said backboard being beyond the corresponding side of the upper face element.

2. A rack according to claim 1, including at least three face elements.

3. A rack according to claim 1, wherein each face element is essentially rectangular in configuration.

4. A rack according to claim 3, wherein each face element is provided with a detent in its top edge.

5. A rack according to claim 1, wherein the bottom of the upper pocket extends into the lower pocket a distance corresponding to about 35 to 40% of the height of the lower pocket.

6. A rack according to claim 7, including at least three face elements each essentially rectangular in configuration and provided with a detent in its top edge.

7. A rack according to claim 1, wherein each face element is thermally joined to its side flaps which in turn are thermally joined to the backboard.

* * * * *

UNITED STATES PATENT AND TRADEMARK OFFICE

CERTIFICATE OF CORRECTION

PATENT NO. : 5,016,760

DATED : May 21, 1991

INVENTOR(S) : Mayo, Stephen I.

It is certified that error appears in the above-identified patent and that said Letters Patent is hereby corrected as shown below:

Col. 2, line 62 Delete " claim 7 " and substitute -- claim 5 --

Signed and Sealed this

Twenty-seventh Day of April, 1993

*Attest:*

MICHAEL K. KIRK

*Attesting Officer*

*Acting Commissioner of Patents and Trademarks*